US005749575A

United States Patent [19]

German

[11] Patent Number: 5,749,575

[45] Date of Patent: May 12, 1998

[54] DUAL MAZE

[76] Inventor: Neal German, 81 Beaver Lake Pl., Divide, Colo. 80814

[21] Appl. No.: 811,744

[22] Filed: Mar. 6, 1997

[51] Int. Cl.[6] ..... A63F 7/00

[52] U.S. Cl. ..... 273/113; 273/110; 273/116; 273/123 R

[58] Field of Search ..... 273/108, 109, 273/110, 113, 115, 116, 118 R, 123 R, 153 R

[56] References Cited

U.S. PATENT DOCUMENTS

| | | | |
|---|---|---|---|
| 3,479,033 | 11/1969 | Crisafulli et al. | 273/113 |
| 3,879,039 | 4/1975 | Holden . | |
| 3,931,972 | 1/1976 | Fabian . | |
| 3,938,807 | 2/1976 | Lüthl et al. . | |
| 3,967,824 | 7/1976 | Lund . | |
| 4,052,067 | 10/1977 | Carmo . | |
| 4,055,341 | 10/1977 | Martinez . | |
| 4,240,628 | 12/1980 | Brownfield | 273/110 X |
| 4,448,416 | 5/1984 | Belter . | |
| 4,512,578 | 4/1985 | Dalton . | |
| 5,213,325 | 5/1993 | Malavazos et al. . | |
| 5,435,555 | 7/1995 | Fuhrer et al. | 273/110 |

OTHER PUBLICATIONS advertisement for Mystery Maze (TM), Marx Catalog, p. 31, received 05 Apr. 1977.

*Primary Examiner*—Raleigh W. Chiu

*Attorney, Agent, or Firm*—Patent & Trademark Services; Thomas Zack; Joseph H. McGlynn

[57] ABSTRACT

A tiltable dual maze game board with rolling ball playing pieces. Each board is identical and can be tilted independently of the other to cause the playing pieces to move up ramps, around obstacles and around or into holes. Each board's control tilt mechanism includes two separate controller assemblies located perpendicular to each other under the board each of which has external handles. Each control assembly has two hinged vertical rods extending to join the board underneath by a ball joint connection. Ball bombs may be thrown from above in an attempt to knock out playing pieces before they reach the final winning hole.

4 Claims, 3 Drawing Sheets

FIG. 1
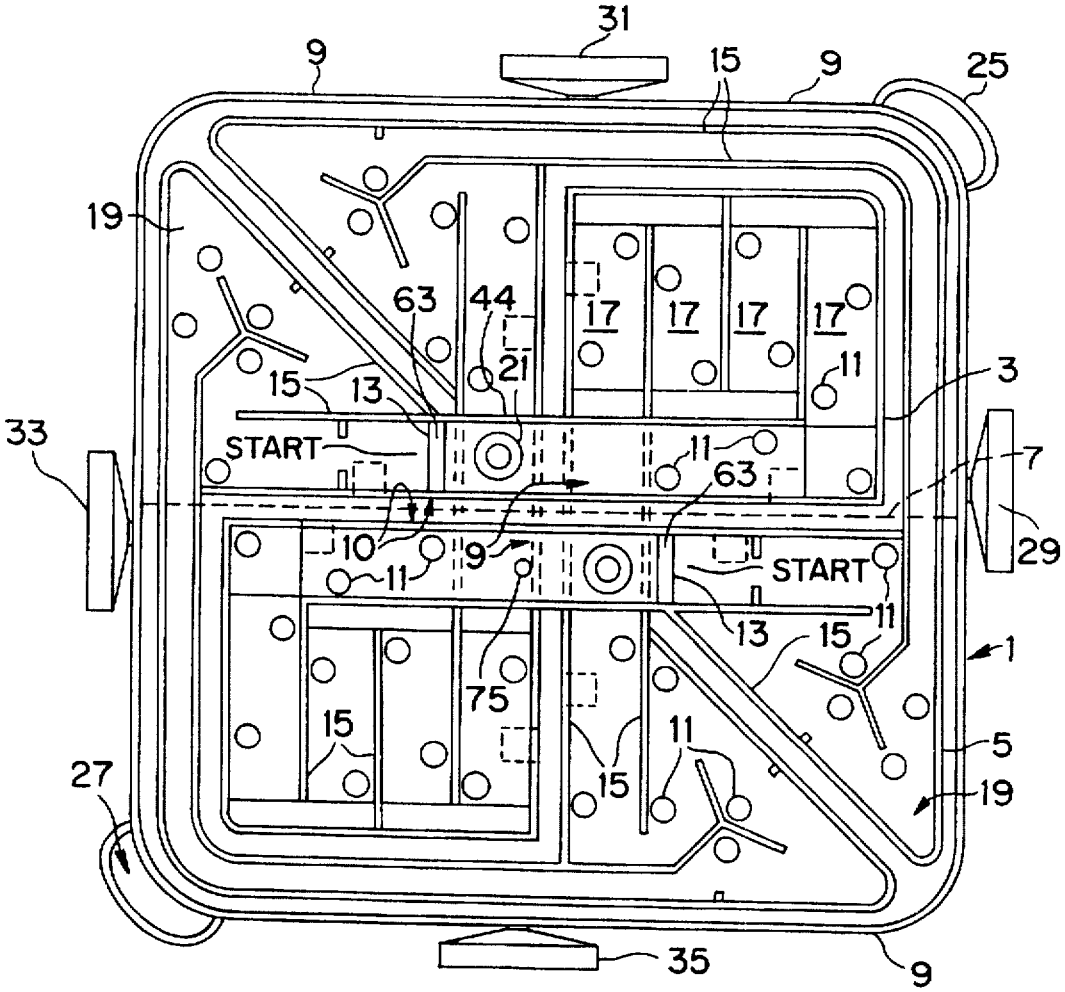
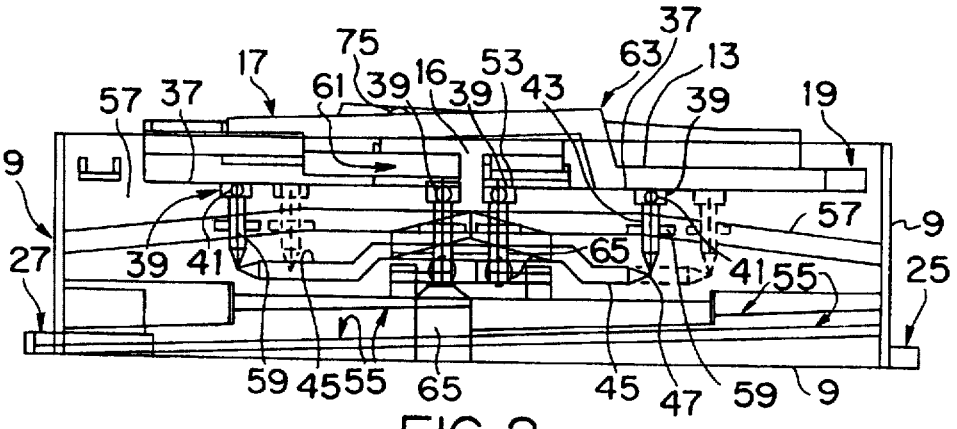
FIG. 2

FIG. 3
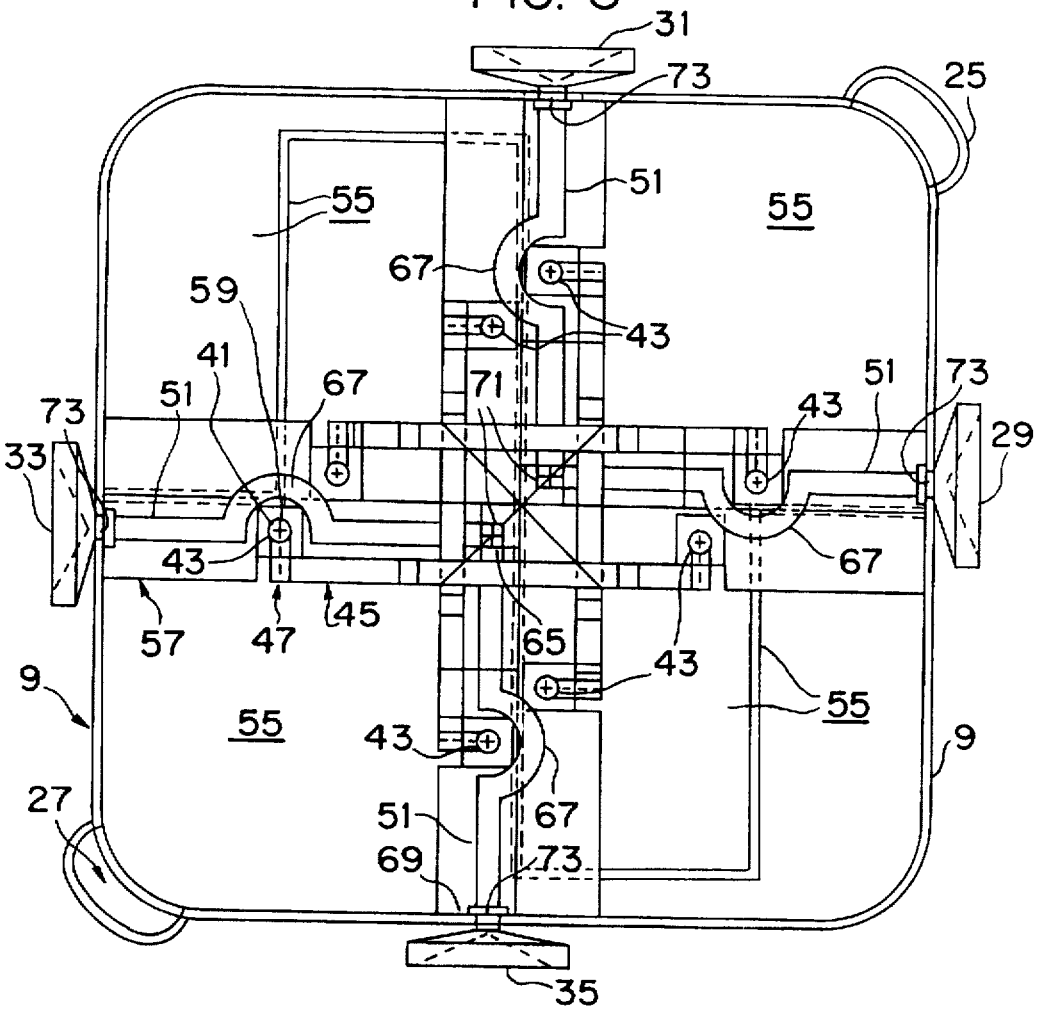
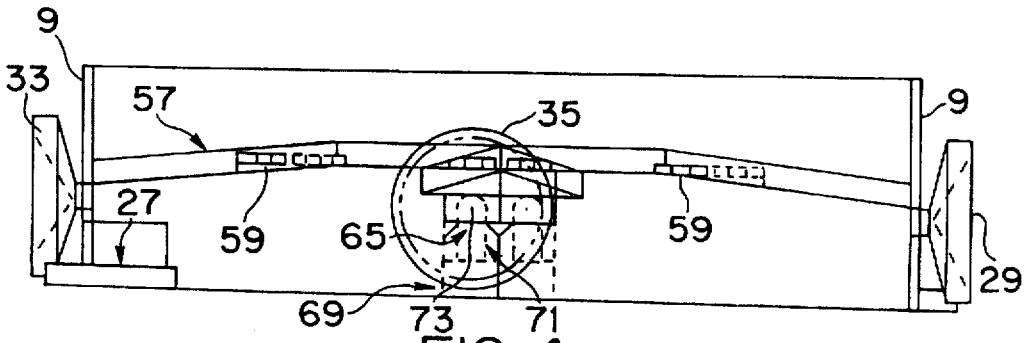
FIG. 4

DUAL MAZE

BACKGROUND OF THE INVENTION

Game boards having movable game pieces which the players move through a tortuous or maze-like path structure are known. In some such games the game board itself is moved as the game pieces, such as marbles, roll on its surface. This movement can be accomplished by manual controllers or handles which extend from the board's side to tilt its surface as the game pieces moves between board surface obstacles. Also, the game board may be made up of interconnected separate mazes or have a motorized drive which the players counter by their surface controllers.

The present invention has a game board with rollable game pieces. Two interlaced identical mazes suspended above an enclosure make up the game board on which the game pieces roll. Each maze has two side controllers which independently control their maze. These controllers are used to mechanically move each maze by moving underneath board linkages to actuate a horizontal shaft, a horizontal lever, two vertical rods and two ball and socket joints. Holes in the game board allow game pieces to fall through the board into the enclosure where they are directed to receptacles. The object of the game is to manipulate the game pieces through the board's surface maze without falling into the holes until a last hole is reached. A drop-off just after the last hole results in the game piece being returned to the maze's starting point to replay the game. Other game pieces designated as bombs can be dropped from above the playing surface to try to cause the other player's game piece to be knocked into a hole and returned to its starting position.

DESCRIPTION OF THE PRIOR ART

Many of the prior art game boards have rolling game pieces which can be manipulated by the players through or around surface obstacles on the game board. For example, in U.S. Pat. No. 3,879,039 to Holden, a tortuous path track with barriers can be moved in a see-saw fashion while a marble moves on it. In some games the players actuate side game board handles or controllers to tilt the game board's surface (i.e. as in U.S. Pat. No. 3,931,972 to Fabian) to move a ball to strike or not strike surface targets or obstacles. A game board surface labyrinthian or maze may have to be transversed by a rolling game piece (U.S. Pat. No. 3,938,807 to Luthl et al). Motorized drives, such as in U.S. Pat. No. 4,448,416 to Belter, have been used to tilt the game board while the players attempt to counter this motion by a manual control mechanism. And in some more intriguing tiltable game boards (e.g., U.S. Pat. No. 5,213,325 to Malavazos et al.) there are holes in the game board surface in which the playing piece may drop while a player moves a board controller. The present invention incorporates some of these features while providing for a movable dual maze board game surface with controllers and rolling and dropped game pieces as further set forth in this specification.

SUMMARY OF THE INVENTION

This invention relates to a dual maze game board having a movable surface and surface obstacles and holes. Two players attempt to independently control the movement of a rolling game piece on each of the board's surfaces by underneath board control assemblies. An overhead bomb object may be used to attempt to strike game playing pieces before they reach their destination.

It is the primary object of the present invention to provide for an improved maze game board having rollable game pieces.

Another object is to provide for a dual maze game board wherein two players can independently control the movement of their game boards and game pieces.

These and other objects and advantages of the present invention will become apparent to readers from a consideration of the ensuing description and the accompanying drawings.

BRIEF DESCRIPTION OF THE DRAWINGS

FIG. 1 is a top view of the invention's preferred embodiment dual maze game board.

FIG. 2 is a side sectional view of one of the FIG. 1 game boards.

FIG. 3 shows a top view of the FIG. 1 game board with its upper board surface removed.

FIG. 4 is a side sectional view of the FIG. 3 game board.

DESCRIPTION OF THE PREFERRED EMBODIMENT

Figure 5:
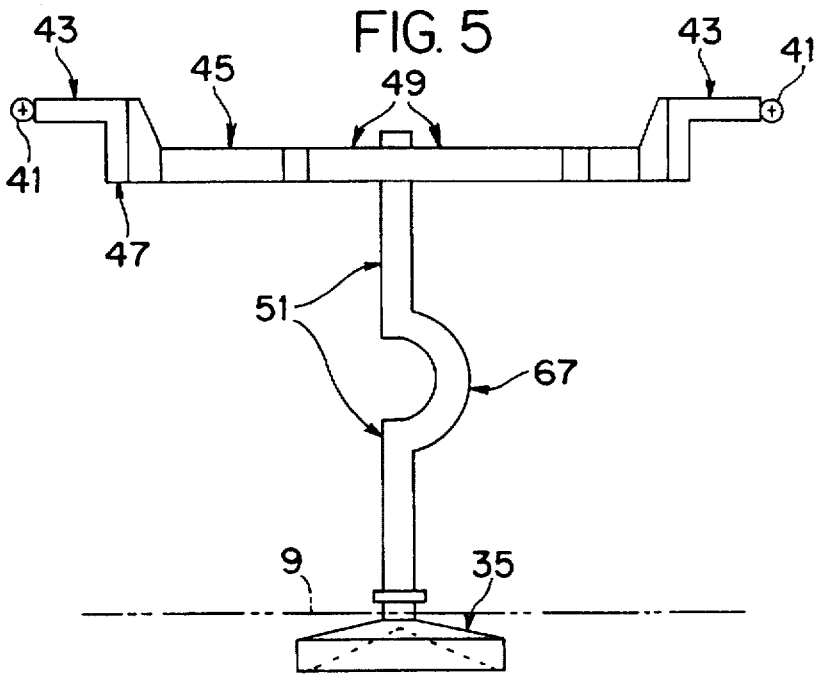
FIG. 5 shows a top view of one of the FIG. 1 game board's control assemblies.

FIG. 1 is a top view of the invention's preferred embodiment dual maze game board 1. Two independently controlled suspended identical maze game boards 3 and 5 abut each other along the center pivot line 7. Both boards are enclosed by a surrounding square plastic enclosure 9 on four sides and the bottom. Located on each board's surface are: board holes 11 which extend from the board's surface to an underneath pathway; indicia 13 indicating a starting location for each player's game piece; upright surface barriers 15 to direct the rollable playing pieces surface movement; and surface ramps 17. Some of these ramps are sloped while others, such as ramps 19 are horizontal. The holes 21 at the top of a ramp are considered final holes of the maze and direct inserted playing pieces to travel ultimately to the other player's board corner drain cup. Getting a game piece in the other player's corner drain cup signifies a win. Two opposite corner drain cups 25 and 27 are used to ultimately receive the board playing pieces which fall through the intermediate surface holes 11 on the respective game boards after they pass through an internal lower pathway.

Other features shown in FIG. 1 include the four side player controllers 29, 31, 33 and 35 used to manipulate the two board's playing surfaces from underneath. Two of these controllers are used to independently operate each of the two game boards. Below each board is a controlling assembly which functions to support the boards in their suspended position and also to control their movement and the movement of a rolling game piece, such as a marble or ball, on the board's upper surface.

FIG. 2 is a side sectional view of one of the FIG. 1 game boards and shows the controlling assembly controlled by one controller. Each player has two of such assemblies perpendicular to each other. Each such assembly is connected to the game board's under surface 37 at two internally molded sockets 39 into which a ball joint 41 is inserted. This joint is located on the top of vertical rod 43 which is in turn connected to horizontal member 45 by a plastic hinge 47. Perpendicular to a joining offset section 49 is a lower straight shaft member 51 connected to one of the four controllers (29, 31,33 ,35 ). Pivot points 53 are located at the axis intersections of each player's two controlling assembly's shaft members 51.

In addition to the game board controlling assembly, FIG. 2 also shows much of the internal playing piece pathway. A lower sloped drain pan 55 directs playing pieces that fall through the holes 11 to the opposite corner drain cups 25 or 27 depending on which board hole they fall through. The holes for a given drain cup are associate with the particular player who controls the movement of the maze game board. Thus, only the playing pieces from that player's game board will end up in a particular drain cup. Below the holes 11 are playing piece directing strips 57 which run from side to side in both directions though the center of the enclosure 9. Elongated holes 59 within the strips (a total of 8) allow the vertical rods 43 to connect to the two playing board's underneath surfaces. Intersection 61 located at the center of the maze is near the last hole 21 and the drop-off surface junction 63 after which the game piece falls back to the starting point 13. At the lower center part of FIG. 2, there also is shown two slots 65 in the lower part of enclosure 9 used to hold the horizontal controlling assembly mechanisms parts.

FIG. 3 shows a top view of the FIG. 1 game board with its upper board surface removed. Each player operates two controllers each of which is connected to a shaft 51 having a curved section 67 to allow space for the vertical rod 43 of the adjacent mechanism and permit them moving up and down. It also allows for a lower profile game board. The shaft's 51 opposite end is connected perpendicularly to near the middle of offset section 49. When shaft 51 is rotated by a player the connected offset section 49 moves which in turn moves the two vertical connected rods 43. Each player can move four of the rods 43 by manipulating the two controllers for his/her particular game board. The plastic hinge connection 47 for each rod 43 allows a certain amount of play such that the vertically disposed rod 43 can have its orientation varied enough to tilt the connected board and move the rollable game pieces.

Plastic protrusion 69 of lower drain pan 55 are located above it on all four sides and two at its center 71. Enclosure side slots 73 allow the four controlling assemblies to enter the enclosure's 9 interior.

Figure 6:
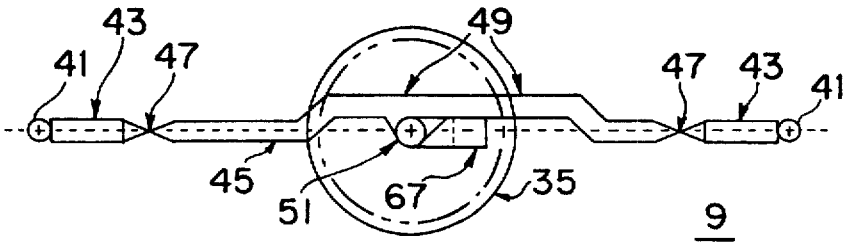
FIG. 6 is a side view of the FIG. 5 game board control assembly.

FIG. 5 shows a top view of one of the FIG. 1 game board's internal control assemblies. There are four of such assemblies in the FIG. 1 game board. It is controlled by turning one of the four controllers (29,31,33 or 35). When this occurs the connected ball joints 41 of hinged vertically disposed rod 43 will change the horizontal disposition of the connected game board. By turning two perpendicular controlling assemblies connected underneath to the same game board, a player may tilt the board through a variety of angular orientations. FIG. 6 is a side view of the FIG. 5 game board control assembly and depicts how the shaft 51 is perpendicularly connected under the offset section 49.

The game is played with two game pieces or balls 75 of different colors and an even number of the same colored balls 77 called bombs (see FIG. 2). Play starts with each game piece placed in its starting area 13. The players attempt to maneuver their game piece past the board's holes 11 under the center intersection and up a series of ramps 17. Finally, the first one to drop their game piece into their hole 21, before the drop-off return 63 to starting area, wins. If the piece enters pass return 63 the player must start again.

The colored balls used as bombs begins with each player having an equal number in their drain cup corner 25 or 27. After play is started, either player can, at any time, stop his game piece at a safe spot in the maze and drop one or more bombs from an altitude of less than one foot above the game board surface and try to knock the opponent's game piece into one of the holes 11. If struck to do so, the game piece will roll back to the opponent's drain cup and his opponent would place the game piece back in the starting area 13 and continue play. Normally, bombs are used when the opponent's game piece is nearing the end of the maze where the course is the most difficult and it becomes critical to stop your opponent from completing the maze and winning the game. Every time you drop a bomb on your opponent's maze, it will eventually fall through a hole 11 and roll to the opponent's drain cup. The better use of bombs and the better ability to maneuver the game piece through the maze will eventually cause one player to run out of bombs, allowing his/her opponent game piece to proceed through the maze with no way for the other player to stop it, almost ensuring a win unless the game piece falls through a wrong hole 11 by mistake.

An optional end game which will be included in the rules for advanced players includes an extra step. To win, your game piece ball must end up in the drain cup at your opponent's corner. If a player maneuvers his game piece into the final hole 21, the game piece will fall directly onto the opponent's maze below it. The player now tries to knock the game piece through a hole 11 on his opponent's maze with bombs, and win the game. If his opponent can maneuver the game piece to the end of his maze hole 21 and drop the game piece back on its original maze the game continue as normal. But, if the game piece goes over the drop-off junction 63 and falls into the starting area 13 or falls through a hole 11 this is a win for the original controller of the game piece.

The recited game board structure would make a game piece which falls through a hole 11 return to the same board. Should the game piece for some reason, like bouncing off one player's maze due to a bomb dropping on it, the game piece would probably roll to the opponent's corner. To deter such high altitude bombing, such action would be considered a win for the controller of the game piece ball knocked to the opponent's board. In the advanced rules, play would continue in this situation. The player that dropped the bomb that caused the opponent's game piece to bounce to the other maze would end up with his opponent's game piece on his maze.

In either set of rules, knocking a game piece completely off the game board with a bomb would be considered a win for the controller of the game piece.

All parts of the game board can be made of molded plastic material. This would include ten parts in total. The two identical mazes would be made of two parts each, the flat section and the ramp inclined sections. The four parts would then be assembled at the same time and either glued or plastic welded together. Once, the two mazes are assembled they may not be separated. The mechanical parts, such as the recited controlling assembly parts, would be molded as four complete units with the vertical rods 43 sticking out horizontally. The assembled parts are manipulated in two different ways. The vertical rods 43 would be bent about 90 degrees up or down at the plastic hinges 47 and each mechanism is inserted into the two slots 65 and 73 in plastic enclosure 9. Portions of the horizontal levers 45 are offset at 49 from the center.

Two opposite mechanisms are assembled into the plastic enclosure 9 with the offset 49 on the top side of the game board, the other two are assembled with the offset 49 towards the bottom side of the game board. This allows the pivot points 53 of both controlling assemblies to be in the same plane. The plastic enclosure 9 has triangle contoured plastic strips 57 running from side to side in both directions through the center of the enclosure. The holes 59 in these strips allow the vertical rods 43 to be pushed through from the underside in the assembly process. The shape of these strips also directs the rolling playing pieces or balls that fall through the maze holes 11 into the correct part of the drain pan 55. This drain pan would be one part, consisting of two opposite sloping flat sections divided by a barrier. It slides into the underside of the plastic enclosure 9 during the assembly process. The two opposite drain cups 25 and 27 are molded as part of the drain pan 55. The drain pan has plastic protrusions 69 above it on all four sides and two at its center 71 that set the heights of the controlling assembly parts.

Although the invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A dual maze game board and playing pieces comprising:

rollable playing pieces;

two substantially identical game boards joined together within an enclosure with each of said boards having surface ramps, upright obstacles and holes through which said playing pieces can fit; and player control means mounted on said enclosure for tilting the playing surface of each of said playing boards independently of the other board, said control means including two controllers for each player oriented generally perpendicular to each other mounted under the playing board's surface and having control handles extending from said enclosure, said control means also including game board suspensions for vertically supporting said game board by vertically disposed rods having lower hinged joints to connect them to a horizontally disposed common shaft.

2. The invention as claimed in claim 1, wherein said horizontally disposed common shaft can be moved by rotating an abutting shaft located perpendicular to it.

3. The invention as claimed in claim 2, wherein said vertically disposed rods have upper ball joints which engage the game board's bottom surface.

4. The invention as claimed in claim 3, also including a game board bomb playing piece which can be thrown at the rollable playing pieces, said bomb piece being adapted to both roll on the board's surface and fit into the game board's holes.

* * * * *